US006431891B1

(12) United States Patent
Billman

(10) Patent No.: US 6,431,891 B1
(45) Date of Patent: Aug. 13, 2002

(54) POWER CONNECTOR WITH EASILY REMOVABLE CONDUCTIVE PIN

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/749,132

(22) Filed: Dec. 26, 2000

(51) Int. Cl.[7] ..... H01R 29/00
(52) U.S. Cl. ..... 439/176; 439/947
(58) Field of Search ..... 439/176, 78, 497, 439/947, 668, 669

(56) References Cited

U.S. PATENT DOCUMENTS

RE26,692 E * 10/1969 Ruehlemann ..... 439/669
4,548,447 A * 10/1985 Dinsmore ..... 439/669
4,824,380 A * 4/1989 Matthews ..... 439/80
5,055,055 A * 10/1991 Bakker ..... 439/80
5,807,120 A * 9/1998 Matthews ..... 439/80

* cited by examiner

*Primary Examiner*—Neil K T Abrams
*Assistant Examiner*—Phuong Dinh
(74) *Attorney, Agent, or Firm*—Wei Te Chung

(57) ABSTRACT

A power connector comprises a housing (20), a metal pin (30) accommodated in a passage (13) of the housing, a number of terminals (60) secured in the housing and abutting against the pin, and a dielectric cover (40) attached to the housing. The cover forms opposite cross blocks (43) which have arcuate lower ends (431) tightly engaging with corresponding recesses (32, 34) defined in the pin, thereby prohibiting the pin from moving longitudinally relative to the housing. The connector forms a plug type power connector with the pin inserted, and forms a receptacle type power connector with the pin removed.

16 Claims, 9 Drawing Sheets

POWER CONNECTOR WITH EASILY REMOVABLE CONDUCTIVE PIN

BACKGROUND OF THE INVENTION

1. Field of the Invention

The present invention relates to an electrical connector, and particularly to a power connector which can be easily converted between a receptacle connector and a plug connector.

2. Brief Description of the Prior Art

U.S. Pat. No. 5,055,055, shown in FIG. 9, discloses a conventional power connector 700. The power connector 700 comprises a conductive body 717, a dielectric shell 715 surrounding the conductive body 717, a plurality of contacts, a metal band 716, and a metallic pin 718 retained in the conductive body 717.

A passage 722 longitudinally extends through the conductive body 717 for receiving the metal band 716. The metal band 716 surrounds and inwardly presses against a portion of the pin 718, which together with the metal band 716 is received in the passage 722. Since the metal band 716 is resilient, the pin 718 is allowed to float within the metal band 716. The conventional power connector 700 is a plug type power connector. However, the power connector 700 cannot be changed to become a receptacle type power connector by simple means, such as by merely removing the pin 718 from the power connector 700.

Hence, an improved power connector is required to overcome the disadvantages of the prior art.

BRIEF SUMMARY OF THE INVENTION

A first object of the present invention is to provide a power connector which facilitates modification between a plug type power connector and a receptacle type power connector;

A second object of the present invention is to provide an easily assembled power connector.

To achieve the above-mentioned objects, a power connector in accordance with the present invention includes an insulative housing, a metal pin, two rows of terminals received in the housing, and a cover attached to the housing.

The housing has a front wall and a. rear wall each defining an opening, and lateral sidewalls separated by a passage in communication with the openings of the front and rear walls, for extension of the pin. Each sidewall defines a row of passageways communicating with the passage and also defines a slot located at lower, outer sides of the passageways.

Each terminal includes a retention section at which the terminals are interconnected, a plurality of soldering tails, and a plurality of mating sections. The rows of terminals are secured in the housing in a way that the retention sections are fit in the corresponding slots and the mating sections are received in the corresponding passageways and protrude into the passage.

The cover forms two opposite cross blocks at longitudinal ends thereof and a rib bedded between the cross blocks. Each cross block forms an arcuate lower end which extends into the passage and is adapted to wedge into a corresponding recess defined in the pin inserted in the passage, thereby limiting a longitudinal movement of the pin relative to the housing.

The power connector is of a plug type when the pin is inserted into the passage and is of a receptacle type when the pin is removed.

Other objects, advantages and novel features of the present invention will become more apparent from the following detailed description of the present embodiment when taken in conjunction with the accompanying drawings.

DETAILED DESCRIPTION OF THE INVENTION

Figure 1:
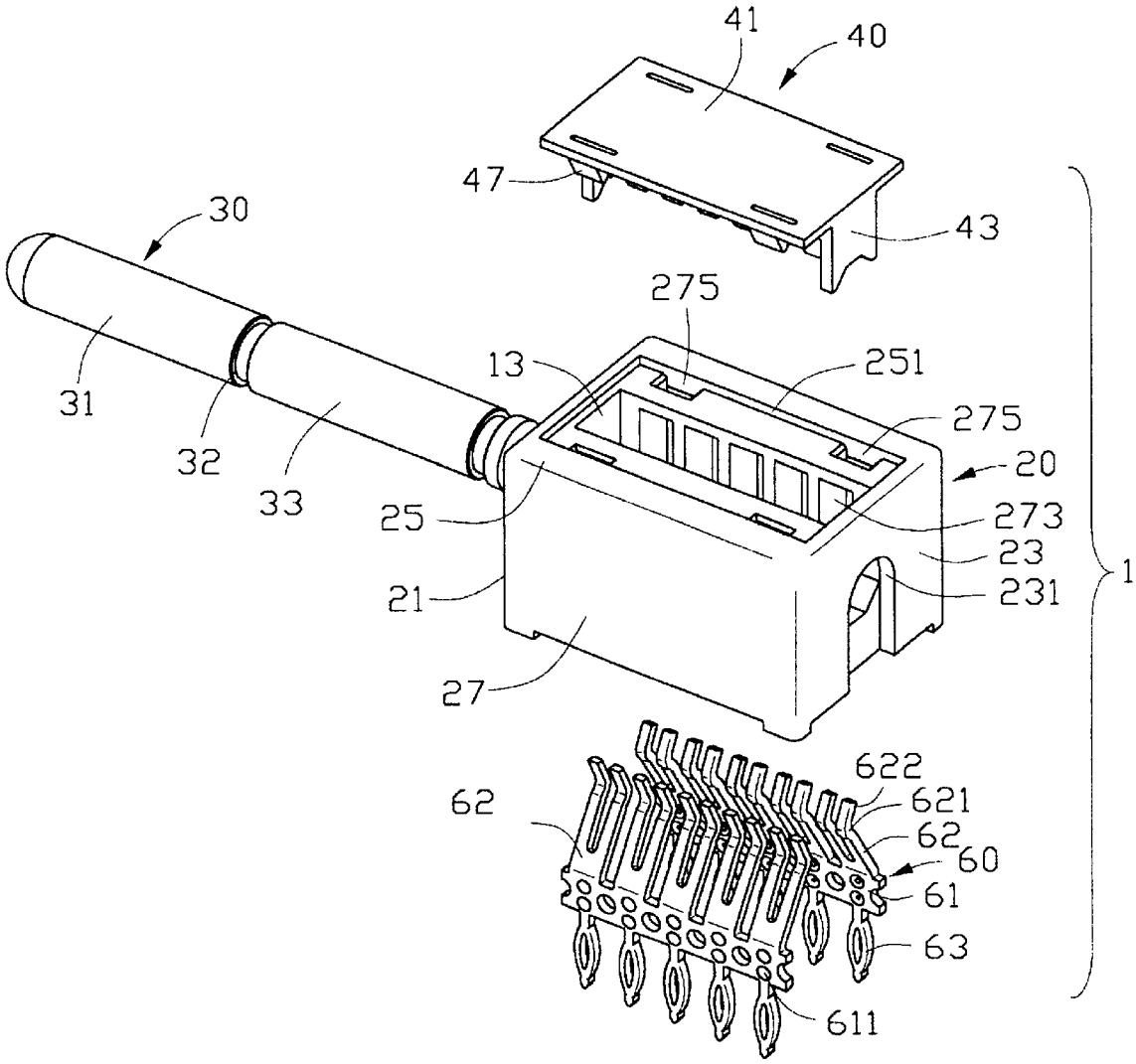
FIG. 1 is an exploded view of a power connector in accordance with the present invention.

Referring to FIG. 1, a plug type power connector 1 of the present invention comprises a dielectric housing 20, an insulative cover 40, a metallic pin 30, and a plurality of terminals 60 arranged in two rows.

Figure 2:
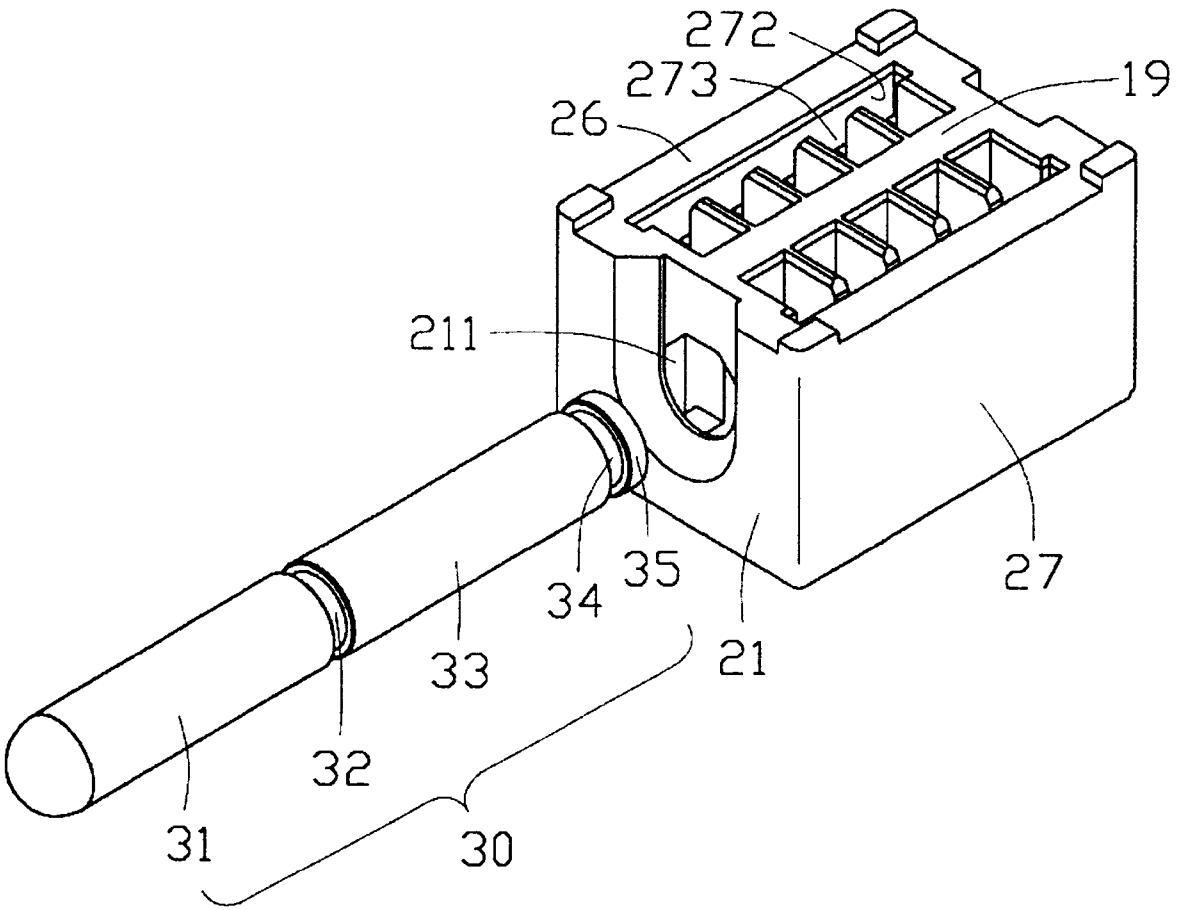
FIG. 2 is a perspective view of a housing and pin of the power connector of FIG. 1 from a different aspect.

Further referring to FIG. 2, the box-like housing 20 includes a front wall 21, a rear wall 23 opposite the front wall 21, a top wall 25, a bottom wall 26 opposite the top wall 25, and a pair of sidewalls 27. The front wall 21 and the rear wall 23 respectively define an opening 211, 231, each opening 211, 231 aligning with the other opening 231, 211. The top wall 25 defines a window 251 symmetrically located therein. A U-shaped passage 13, communicating with and aligned with openings 211, 231, descends from the window 251 and therefore separates the sidewalls 27 from each other. A dam 19 underlies the passage 13 and is parallel to the sidewalls 27. Each sidewall 27 defines a row of passageways 273 in an inner surface thereof, each passageway 273 extending downwardly through the bottom wall 26. A slot 272 extends upwardly from the bottom wall 26 and communicates with an outer, lower side of each passageway 273 in a given sidewall 27. The sidewalls 27 further define four apertures 275 symmetrically located at edges of the window 251 of the top wall 25. Each aperture 275 communicates with the window 251.

Figure 3:
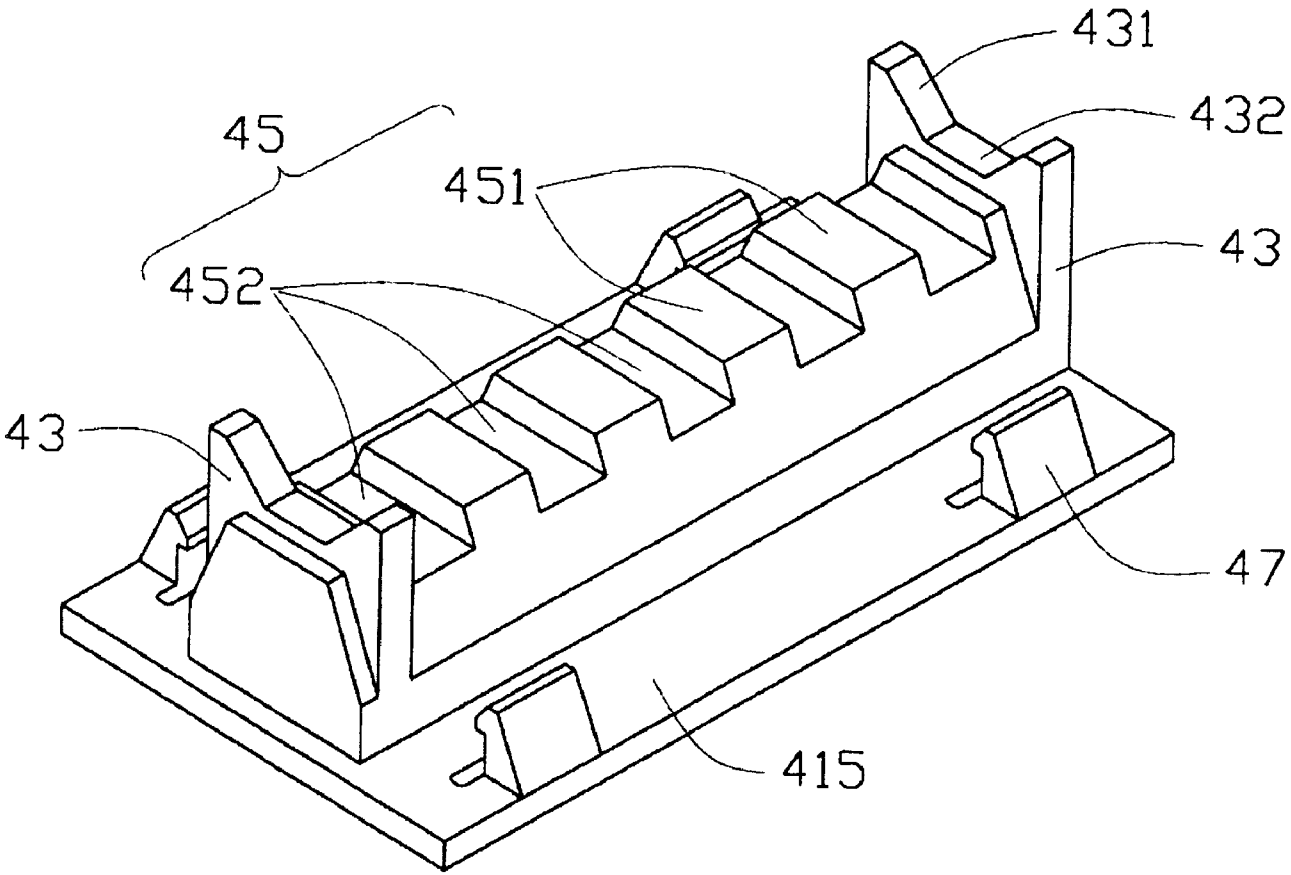
FIG. 3 is a perspective view of a bottom side of a cover of the power connector of FIG. 1.

The cover 40 comprises a planar base 41 having a bottom surface 415, a pair of cross blocks 43 depending from the bottom surface 415, an elongate rib 45 bedded between the cross blocks 43, and two pairs of inwardly facing latches 47 formed at lateral sides of the bottom surface 415. The cross blocks 43 are located at middle portions of opposite longitudinal ends of the bottom surface 415 and each has an arcuate lower end 431 extending beyond the rib 45. As is shown in FIG. 3, the distance between the bottom surface 415 of the base 41 and a lower surface of the rib 45 is shorter than that between the bottom surface 415 and an apex 432 of the arcuate lower end 431. The rib 45 has five cutouts 452 arranged at intervals between projections 451.

The pin 30 includes a front section 31, an intermediate section 33, and a rear section 35. An annular recess 32 is defined between the front section 31 and intermediate section 33. Similarly, an annular recess 34 separates the rear section 35 from the intermediate section 33.

Each terminal 60 comprises a retention section 61, five soldering tails 63 depending from the retention section 61 for soldering into a printed circuit board (not shown), and five mating sections 62 projecting upwardly and inwardly from the retention section 61. Each mating section 62 is fork shaped with a reversed free end 622. The free end 622 of each mating section 62 has a contacting section 621, at which the free end 622 bends.

Figure 4A:
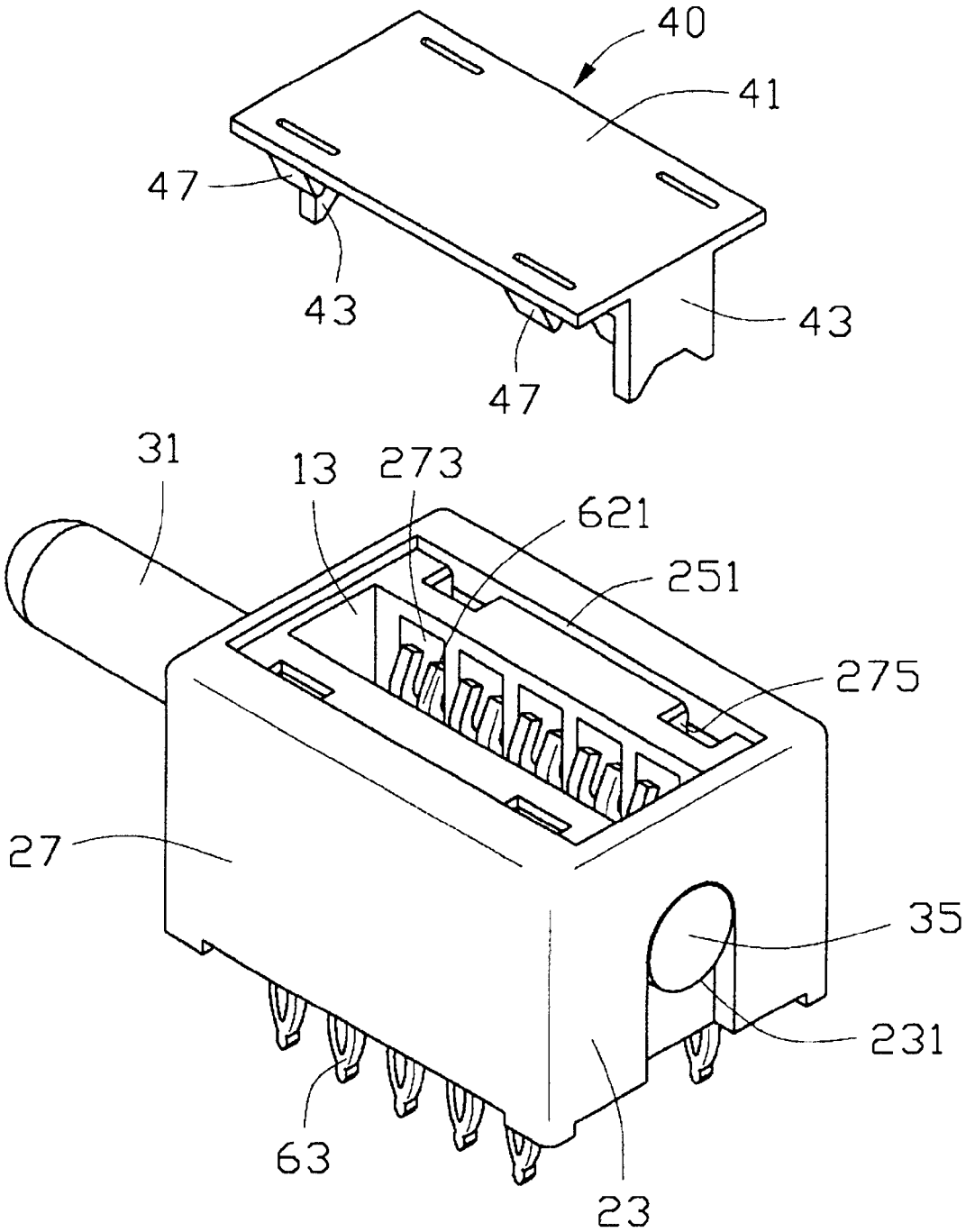
FIG. 4A is a partially assembled view of the power connector of FIG. 1.
Figure 4B:
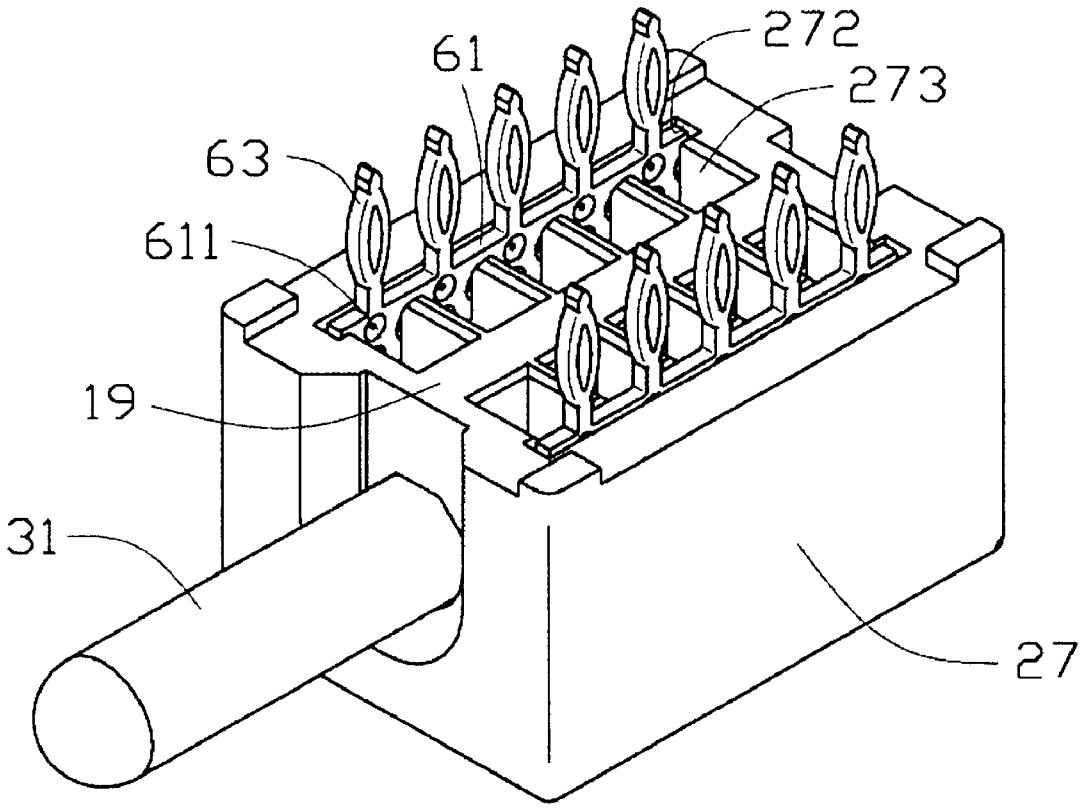
FIG. 4B is a reversed view of the power connector of FIG. 4A.
Figure 4B:
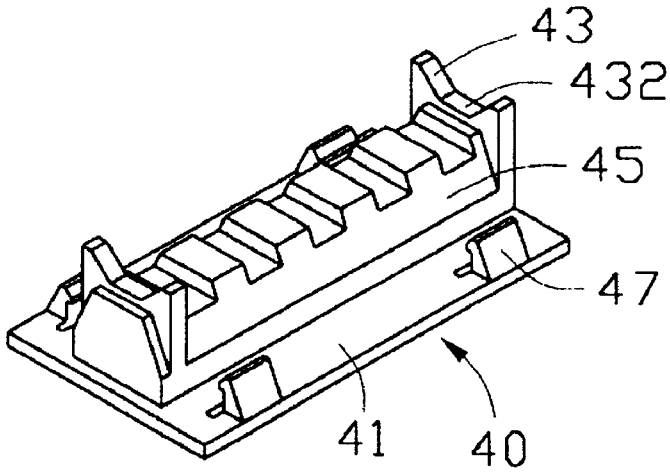
Figure 5:
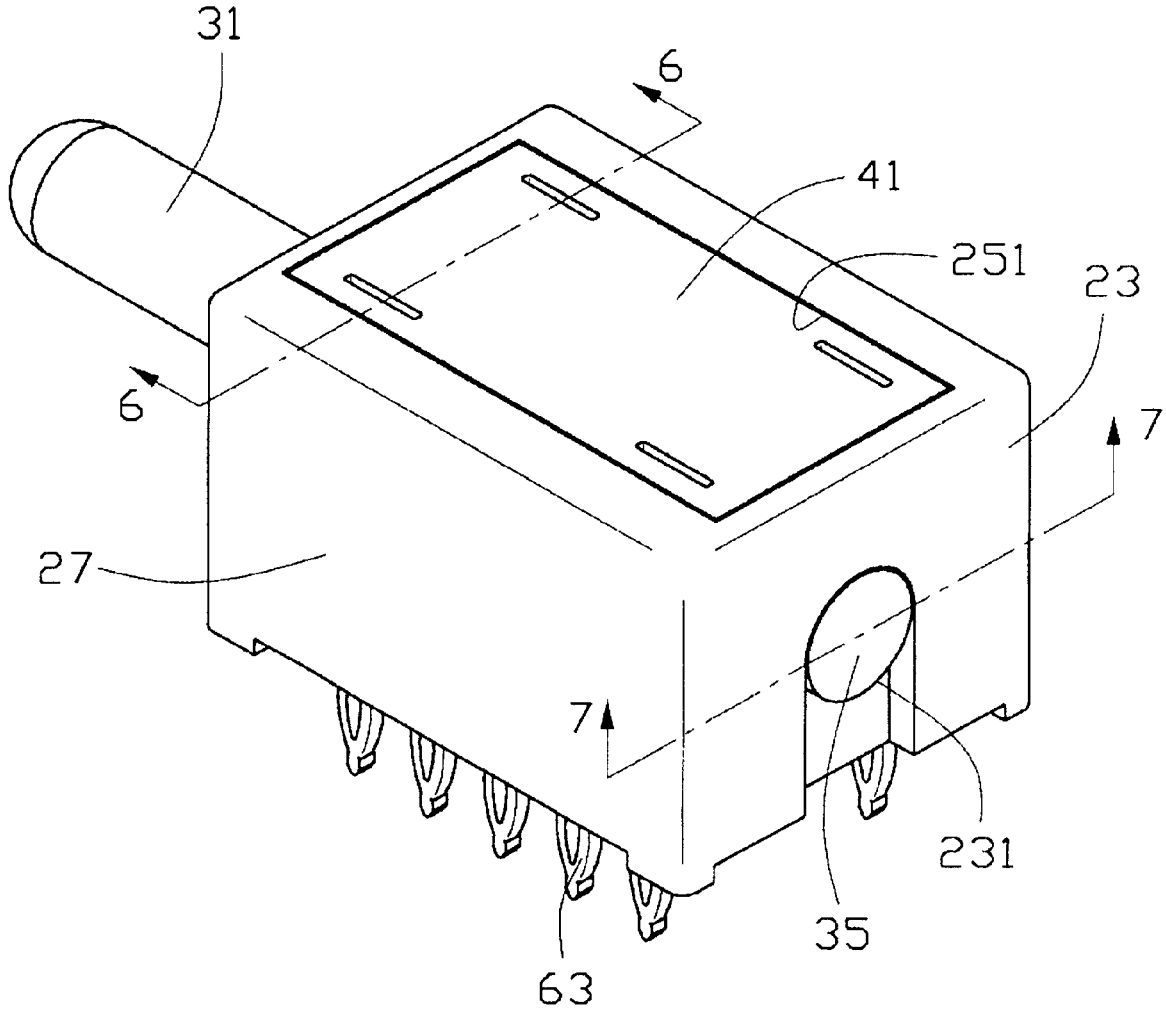
FIG. 5 is an assembled view of the power connector of FIG. 1.

In assembly, referring to FIGS. 4A, 4B and 5, the pin 30 is first inserted into the passage 13 of the housing 20. The terminals 60 are subsequently inserted into the housing 20 upwardly from the bottom wall 26. The cover 40 is then pressed onto the top wall 25 of the housing 20.

The pin is supported by the dam 19 of the housing 20 with the rear section 35 fitted in the opening 231 of the rearwall 23 and the front section 31 protruding from the front wall 21 of the housing 20 for mating with a complementary connector (not shown). Each terminal 60 is retained in the housing 20 so that the retention section 61 is fixed within the slot 272 of the corresponding sidewall 27, with dimples 611 of the retention section 61 interferingly engaging with a side of the slot 272, and the mating sections 62 being received within the corresponding passageways 273 of the corresponding sidewall 27. The contacting section 621 of each mating section 62 resiliently abuts against an upper portion of the inserted pin 30 for establishing an electrical path therebetween.

Figure 6:
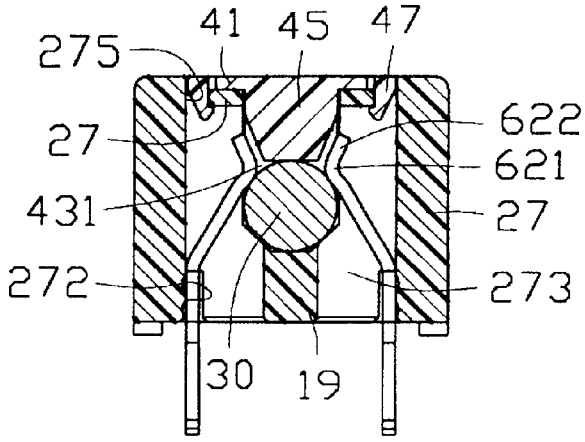
FIG. 6 is a cross-sectional view of the power connector taken along the line 6—6 of FIG. 5.
Figure 7:
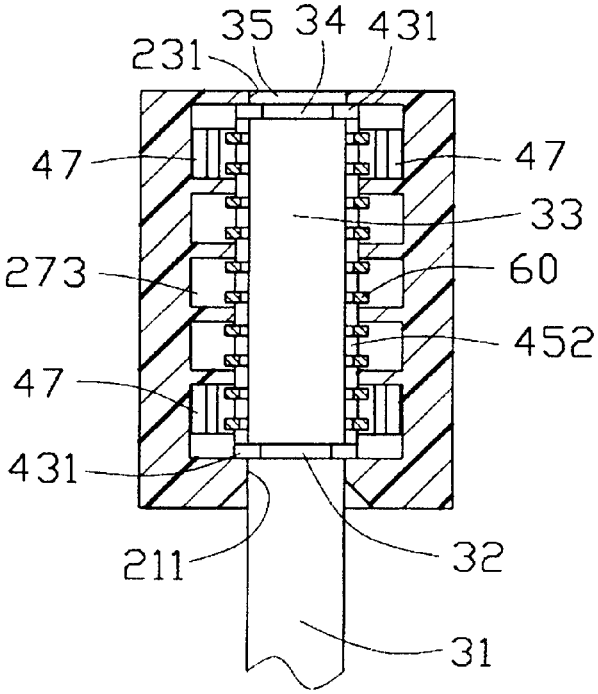
FIG. 7 is a sectional view of the power connector taken along the line 7—7 of FIG. 5.

As is best shown in FIGS. 6 and 7, the cover 40 is firmly attached to the housing 20 by the latches 47 snappingly engaging with the corresponding apertures 275 of the sidewalls 27. The base 41 of the cover 40 fits into the window 251 of the housing 20 while the cross blocks 43 and rib 45 extend into the passage 13. The lower ends 431 of the cross blocks 43 wedge into the corresponding recesses 32, 34 of the pin 30. Since the lower ends 431 are arcuate, the cross blocks 43 tightly mate with the recesses 32, 34 and eliminate longitudinal movement of the pin 30 with respect to the housing 20. The rib 45 extends into the passage 13 such that each cutout 452 aligns with a pair of corresponding passageways 273, allowing the free ends 622 of the terminals 60 to laterally move within the passage 13. The projections 451 are interposed between adjacent free ends 622, preventing the free ends 622 from inadvertently contacting each other.

Figure 8:
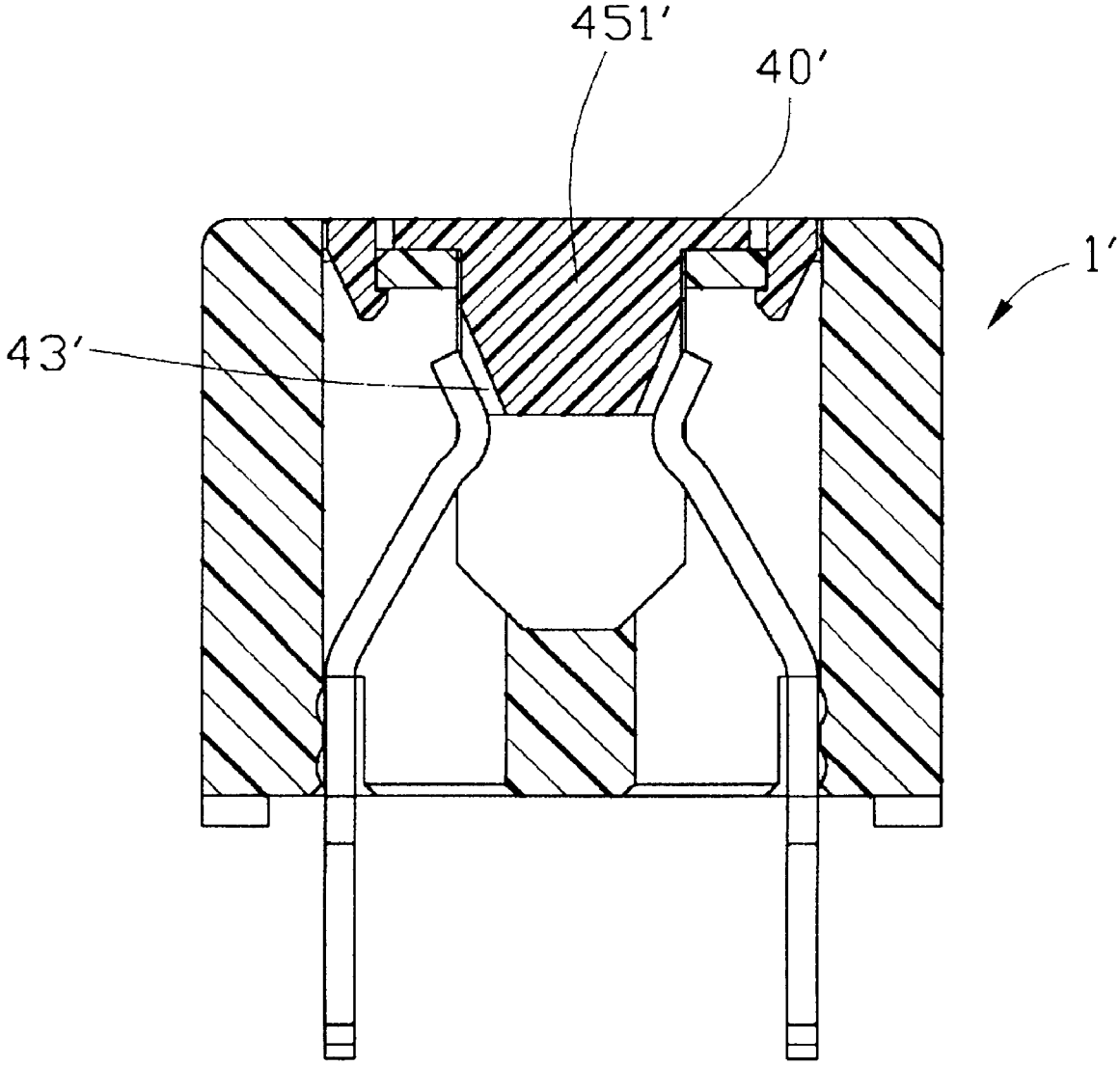
FIG. 8 is a cross-sectional view of the power connector of the present invention configured as a receptacle connector.
Figure 9:
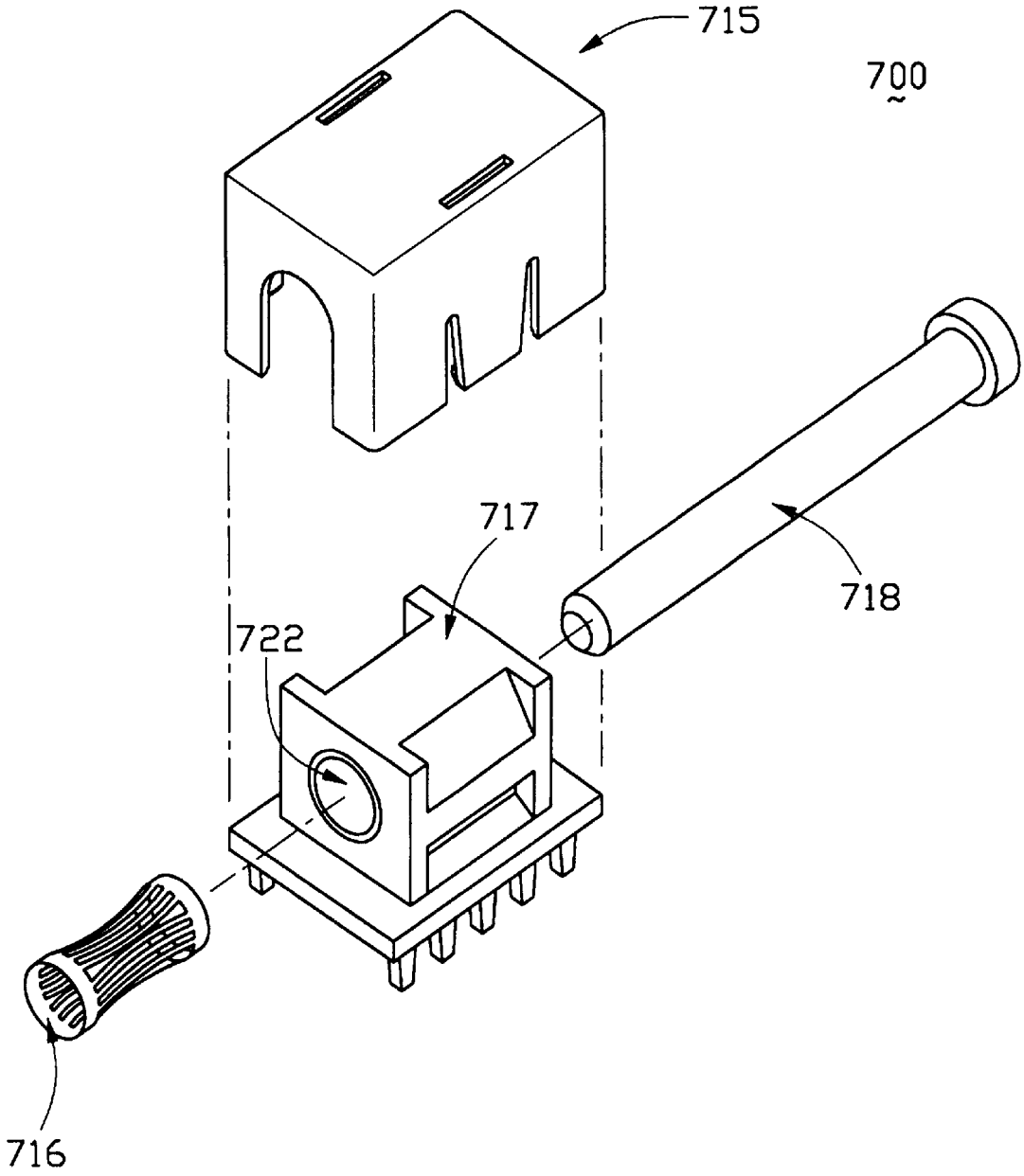
FIG. 9 (PRIOR ART)
FIG. 9 is an exploded view of a conventional power connector.

A receptacle type power connector 1' in accordance with the present invention is provided in FIG. 8. The receptacle type power connector 1' is essentially the same as the plug type power connector 1 except that the pin 30 of the power connector 1 is omitted and a cover 40' of the power connector 1' provides two opposite cross blocks 43' whose lower ends are flush with the projections 451' as shown in FIG. 8. Accordingly, the cross blocks 43' permit insertion of a pin of a complementary power connector.

It is a feature of the present invention that the plug type power connector 1 can be easily converted to a receptacle type power connector 1'. The pin 30 of the plug type power connector 1 is removeable from the housing 20 and the cover 43 of the plug type power connector 1 is replaceable with the cover 43' of the receptacle type power connector 1', thereby converting the plug type power connector 1 to a receptacle power connector 1' andallowing insertion of a pin of a complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector for mating with a complementary connector, comprising:

an insulative housing defining a longitudinally extending passage and at least a passageway located beside and communicating with the passage;

a dielectric cover attached to the housing;

a metallic pin extending through the passage;

at least a conductive terminal received in the at least a passageway and having a mating section extending from a corresponding passageway into the passage for resiliently abutting against and electrically contacting the pin; and securing means for retaining the pin in the passage;

wherein the securing means has a first securing portion on the cover and a second securing portion in the pin, the second securing portion being engageable with the first securing portion.

2. The power connector as claimed in claim 1, wherein the first and second securing portions are detachable for allowing removal of the pin from the passage of the housing.

3. The power connector as claimed in claim 2, wherein the pin is removeable for converting the plug connector to a receptacle connector.

4. The power connector as claimed in claim 1, wherein the first securing portion of the cover is at least a cross block and the second securing portion of the pin is at least a recess, the cross block engaging with the recess to prevent the pin from moving with respect to the housing.

5. The power connector as claimed in claim 4, wherein the at least a cross block has an arcuate bottom surface for tightly mating with the at least a recess of the pin.

6. A power connector for mating with a complementary connector, comprising:

an insulative housing defining a longitudinally extending passage and at least a passageway located beside and communicating with the passage;

a dielectric cover attached to the housing;

a metallic pin extending through the passage;

at least a conductive terminal received in the at least a passageway and having a mating section extending from a corresponding passageway into the passage for resiliently abutting against and electrically contacting the pin; and securing means for retaining the pin in the passage;

wherein the pin provides a rear section fittingly engaging with a peripheral wall of an opening defined in a wall of the housing, the rear section having a rear surface flush with an outer side of the wall of the housing.

7. A receptacle power connector for mating with a complementary connector, comprising:

an insulative housing defining a longitudinally extending passage, and at least a passageway defined in a sidewall of the housing and communicating with the passage;

a dielectric cover attached to the housing, the cover having a base fitting within the window for covering the passage and at least a cross block depending from the base through the window toward the passage, the cross block being sized to allow insertion of a pin of complementary connector;

at least a conductive terminal received in the at least a passageway and having a mating section protruding into the passage for touching the pin of the complementary connector.

8. The receptacle power connector as claimed in claim 7, wherein the cover defines at least a cutout in the base thereof in alignment with the passageway thereby allowing the mating section to resiliently move within the passage in a direction transverse to a direction along which the pin is inserted.

9. The receptacle power connector as claimed in claim 8, wherein the cover forms a projection between free ends of each two adjacent mating sections thereby prohibiting the free ends from accidentally contacting each other.

10. The receptacle power connector as claimed in claim 9, wherein the housing defines at least a slot communicating with an outer side of the at least a passageway and extending through a bottom side of the housing for maintaining a portion of the terminal.

11. The receptacle power connector as claimed in claim 7, wherein the mating section provides at least a contacting section located, when the terminal is assembled in the housing, at an upper portion of the passage for abutting with a pin of the complementary connector and the mating section extends substantially transversely toward the pin.

12. A power connector comprising:

an insulative housing defining a longitudinal extending passage and at least a passageway located communicatively beside said passage, said passage exposed to an exterior via a window formed in a top face of the housing;

a metallic pin extending through said passage;

at least a conductive terminal received in at least a passageway and mechanically and electrically contacting the pin; and a cover attached to said housing, not only covering said window and said passage but also securing the pin in position for preventing axial movement of said pin along said passage.

13. A power connector for mating with a complementary connector, comprising:

an insulative housing defining a longitudinally extending passage and at least a passageway located beside and communicating with the passage;

a dielectric cover attached to the housing;

a metallic pin extending through the passage;

at least a conductive terminal received in the at least a passageway and having a mating section extending from a corresponding passageway into the passage for resiliently abutting against and electrically contacting the pin; and securing means for retaining the pin in the passage;

wherein the housing defines at least a slot communicating with an outer side of the at least a passageway and extending through a bottom side of the housing for securing a portion of the terminal.

14. A power connector for mating with a complementary connector, comprising:

an insulative housing defining a longitudinally extending passage and at least a passageway located beside and communicating with the passage;

a dielectric cover attached to the housing;

a metallic pin extending through the passage;

at least a conductive terminal received. in the at least a passageway and having a mating section extending from a corresponding passageway into the passage for resiliently abutting against and electrically contacting the pin; and securing means for retaining the pin in the passage;

wherein the cover forms at least a cutout aligning with the at least a passageway, thereby allowing a corresponding mating section toresiliently move within the passage in a direction transverse to a direction along which the pin is inserted.

15. A power connector for mating with a complementary connector, comprising:

an insulative housing defining a longitudinally extending passage and at least a passageway located beside and communicating with the passage;

a dielectric cover attached to the housing;

a metallic pin extending through the passage;

at least a conductive terminal received in the at least a passageway and having a mating section extending from a corresponding passageway into the passage for resiliently abutting against and electrically contacting the pin; and securing means for retaining the pin in the passage;

wherein the at least a terminal has at least two mating sections per terminal and the cover provides a projection which extends between free ends of adjacent mating sections thereby prohibiting the free ends from accidentally contacting each other.

16. The power connector as claimed in claim 12, wherein the cover provides a base fitting within the window for covering the passage and at least a cross block engageable with the pin for positioning the pin in the housing, the cross block extending transversely toward the pin.

* * * * *